US009738997B2

(12) United States Patent
Elliott et al.

(10) Patent No.: US 9,738,997 B2
(45) Date of Patent: Aug. 22, 2017

(54) ERGONOMIC PANTOGRAPH HANDLES

(71) Applicant: Gammill, Inc., West Plains, MO (US)

(72) Inventors: Daniel Lee Elliott, West Plains, MO (US); Joseph Wesley Bauman, Cabool, MO (US); John Ray Busé, Houston, MO (US); Bettilou Kenney Langford, Stockton, MO (US)

(73) Assignee: Gammill, Inc., West Plains, MO (US)

( * ) Notice: Subject to any disclaimer, the term of this patent is extended or adjusted under 35 U.S.C. 154(b) by 0 days.

(21) Appl. No.: 14/689,789

(22) Filed: Apr. 17, 2015

(65) Prior Publication Data

US 2015/0299922 A1 Oct. 22, 2015

Related U.S. Application Data

(60) Provisional application No. 61/980,677, filed on Apr. 17, 2014.

(51) Int. Cl.
*D05B 11/00* (2006.01)
*D05B 69/04* (2006.01)

(52) U.S. Cl.
CPC ..... *D05B 11/00* (2013.01); *D05B 69/04* (2013.01); *D05D 2205/06* (2013.01)

(58) Field of Classification Search
CPC ..... D05B 11/00; D05B 19/00; D05B 19/003; D05B 19/006; D05B 19/02; D05B 19/04; D05B 19/06; D05B 19/08; D05B 19/085; D05B 19/12; D05B 19/14; D05B 19/16; D05B 69/00; D05B 69/04; G05B 2219/2626; G05B 2219/45195; D05D 2205/06
USPC ..... D15/69, 72
See application file for complete search history.

(56) References Cited

U.S. PATENT DOCUMENTS 2,479,017 A * 8/1949 Merson ..... D05B 81/00 112/169
2,484,495 A * 10/1949 Fischbein ..... D05B 13/00 112/11
5,027,726 A * 7/1991 Brower ..... D05B 11/00 112/117
5,209,171 A * 5/1993 Anderson ..... D05B 23/00 112/137
5,711,236 A * 1/1998 Badger ..... D05B 11/00 112/117
6,631,688 B1 * 10/2003 Maag ..... D05B 11/00 112/118
6,860,211 B2 * 3/2005 Valeriote ..... D05B 11/00 112/117
7,124,696 B2 * 10/2006 Lobur ..... D05B 23/005 112/7

(Continued)

*Primary Examiner* — Ismael Izaguirre
(74) *Attorney, Agent, or Firm* — Husch Blackwell LLP

(57) ABSTRACT

The present invention relates to a quilting machine and more specifically a long-arm stitching machine, or stitcher. The stitcher includes handles that are used to trace a laser dot on a pantograph pattern located in front of the fabric being quilted. Tracing the laser dot ensures that the needle and thread associated with the sewing machine head duplicates the pattern being traced. In the present invention, the handles are placed to one side of the sewing machine head to allow an operator to remain upright when watching the laser trace the pattern or the needle and thread quilting the fabric.

11 Claims, 3 Drawing Sheets

(56) References Cited

U.S. PATENT DOCUMENTS

| | | | | |
|---|---|---|---|---|
| 7,207,281 | B1 * | 4/2007 | Kasa | D05B 11/00 112/117 |
| 7,552,691 | B1 * | 6/2009 | Martelli | D05B 3/24 112/117 |
| 8,297,211 | B2 | 10/2012 | Stokes | |
| 2003/0079666 | A1 * | 5/2003 | Barrus | D05B 11/00 112/117 |
| 2004/0083579 | A1 * | 5/2004 | Furr-Britt | A47L 9/325 16/421 |
| 2004/0182295 | A1 * | 9/2004 | Pfeifer | D05B 39/005 112/119 |
| 2006/0112866 | A1 * | 6/2006 | Pfeifer | D05B 11/00 112/117 |
| 2009/0272304 | A1 * | 11/2009 | Watts | D05B 11/00 112/118 |
| 2010/0186646 | A1 | 7/2010 | Stokes | |
| 2013/0190916 | A1 | 7/2013 | Schnaufer | |

* cited by examiner

ERGONOMIC PANTOGRAPH HANDLES

CROSS-REFERENCE TO RELATED APPLICATIONS

This application claims the benefit of U.S. Provisional Application No. 61/980,677, filed Apr. 17, 2014.

BACKGROUND OF INVENTION

The present invention relates to sewing. In particular, the invention relates to particular styles of sewing that incorporate decorative stitching such as quilting. A quilt is a type of blanket typically having three layers: a decorative top layer, a middle layer of insulating material, and a backing layer. "Quilting" refers to the technique of joining these layers by stitches or ties.

Traditional quilting was done by hand and was very labor intensive. The invention of the sewing machine changed that. Quilting evolved from production of functional blankets by specialized artisans into a popular hobby enjoyed by many.

Modern quilts are typically made using a long-armed sewing machine, or stitcher, attached to a frame. The frame supports and holds the workpiece in place while the sewing machine moves along the frame with respect to the workpiece. A typical quilting apparatus illustrating the relationship between the workpiece, frame, and sewing machine is shown in US Patent Pub. No. 2013/0190916.

A common way to quilt today is to use what is known as pantograph patterns. Pantographs are a way to "trace" a pre-printed stitch pattern with the machine in order to stitch that pattern onto the fabric. This allows very consistent work to be completed with a much lower skill level required versus traditional hand-guided stitching alone.

This is normally accomplished by mounting a paper pattern on the rear of the table supporting the frame and workpiece. A laser pointer may be mounted to the stitcher head. The operator may set up the needle/thread at the front of the machine, and operate the stitcher from the rear of the machine. Handles may be provided at the rear of the machine head to allow the operator to move the head from the rear of the table. By "tracing" the paper pattern with the laser dot, the operator is able to reproduce the patterns from the paper template to the fabric being sewn. Normally, these rear handles are mounted on opposing sides of the head. The user grips the handles by reaching "around" the machine.

FIGS. 1 and 2 are representative of prior art long-armed sewing machine heads 10. FIG. 1 is a perspective view of a rear portion of a long-armed sewing machine head 10 (hereinafter referred to simply as head 10), and FIG. 2 illustrates a rear view of the same head 10.

Head 10 may be used in conjunction with a table including frames used to stretch and hold the fabric to be quilted, as taught in US Patent Pub. No. 2013/0190916. FIG. 1 illustrates the rear portion of a head 10. The other side of head 10 is not illustrated, where the needle and thread are preferably located, and stitching takes place. A laser (not illustrated) may be attached to the top surface of head 10 such that it points downwardly at a table including a pantograph pattern located in front of a quilt on rollers of a table. Thus an operator of a sewing machine similar to head 10 may use handles such as handles 20 to move head 10 such that the dot or other projection produced by the laser traces the pattern of the pantograph in front of the quilt.

In FIGS. 1 and 2, handles 20 are mounted on opposing sides of the head 10. In operation, when an operator is tracing the pantograph pattern with the laser dot, head 10 moves such that it reproduces the same pattern projected by the dot or other projection, ensuring that the needle and thread at the front portion of head 10 is reproducing the pantograph pattern in its stitches on the quilt or other textile, in order to either see the laser dot tracing the pantograph pattern or to see that the needle and thread are functioning properly and generating the correct pattern, an operator must lean to one side or the other of head 10, which may generate a strain on the operator's neck and/or back.

Head 10 includes a number of components that are recognizable to those skilled in the art. Head 10 includes cone holders 30, 35 which preferably may be semi-permanently or permanently mounted to each handle 20. Cone holders 30, 35 of the illustrated embodiments are known in the art for holding large cones of thread used in making a quilt (small horizontal spool holders for holding smaller spools of thread are not illustrated). Cone holders 30, 35 are substantially similarly sized and shaped, and cone holders 30, 35 are preferably in substantial alignment with one another. Prior art head 10 further includes a back hand wheel 40 for manually raising and lowering the needle. Head 10 also includes a belt guard 50 for shielding fingers, hair, jewelry, and other objects from getting caught in the motor belt. As FIG. 2 illustrates, head 10 may further include a thread guide 60 for controlling thread extending from a large cone of thread associated with cone holder 30 as it extends to the needle associated with the front portion of head 10. Head 10 may further include other components known throughout the art including a plug for providing power to a mounted laser, thread and tension guides, and, light and power switches (not illustrated).

The conventional handle configuration shown in FIGS. 1 and 2 has several shortcomings. The user is not positioned in an ergonomically optimal position because the configuration of the handles does not allow for the user to stand upright and view the pattern and laser dot directly in front of them. Rather, the user must lean to the left to see the pattern and laser dot. In addition, it is not possible to see the needle during stitching as the user is placed almost directly behind the machine. The location of the handles also necessarily positions the user within close proximity of moving parts of the stitcher, which may pose safety risks.

SUMMARY OF INVENTION

The present invention relates to a quilting machine, more specifically a long-armed stitching machine, or stitcher. The stitcher includes a sewing head that includes the sewing machine used to quilt fabric. The fabric may be stretched between two rollers of a frame below the stitcher. An operator at the rear portion of the stitcher may steer the head using handles such that a laser associated with the head that points downwardly traces a pantograph pattern located in front of and below the fabric. By tracing the pantograph pattern with the laser, the operator can provide that the needle and thread at the front portion of the head produces the same pattern in front of and below the fabric.

In one example embodiment, the stitcher head of the present invention may include an L-shaped arm member that extends from the left side portion of the head, relative to its operator's position, and extends rearwardly toward the operator therefrom. The arm member may also include a projection extending therefrom for mounting a laser to the projection. The laser mounted to the projection may be used to trace a pantograph pattern, thus ensuring that the thread and needle associated with the sewing head produces a substantially similar pattern.

In other embodiments the laser associated with the head is not mounted, to the projection and may be mounted directly to the arm member or elsewhere on the head. In any case, the laser does not interfere with the operation of the head in the quilting process, and the dot or alternative projection generated by the laser used to trace the pantograph pattern is not obstructed.

The arm member further may include handles attached thereto for steering the sewing head. Any attachment member may be used to selectively engage the handles with the sewing head, but the L-shaped arm member is the preferred attachment member. The handles are preferably offset from the sewing head, preferably adjacent to the left side of the head (when viewed from the rear). Alternatively, the handles may be adjacent to the right side of the head. The head also may include a number of components known throughout the art that are commonly associated with long-arm stitchers.

The head may include cone holders which may be semi-permanently or permanently mounted to each handle on opposing sides of the head. The cone holders may be of the type known in the art for holding large cones of thread used in making a quilt. The cone holders may be substantially similarly sized and shaped, and the holders may be in substantial alignment with one another. The head may further include a back hand wheel for manually raising and lowering the needle. The head may also include a belt guard for shielding fingers, hair, jewelry, and other objects from getting caught in the motor belt. Moreover, the head may further include a thread guide for controlling thread extending from a large cone of thread associated with a cone holder as it extends to the needle associated with the front portion of the head.

DESCRIPTION OF THE SEVERAL VIEWS OF THE DRAWINGS

In the accompanying drawings, which form a part of the specification and are to be read in conjunction therewith in which like reference numerals are used to indicate like or similar parts in the various views.

DETAILED DESCRIPTION OF THE INVENTION

Figure 3:
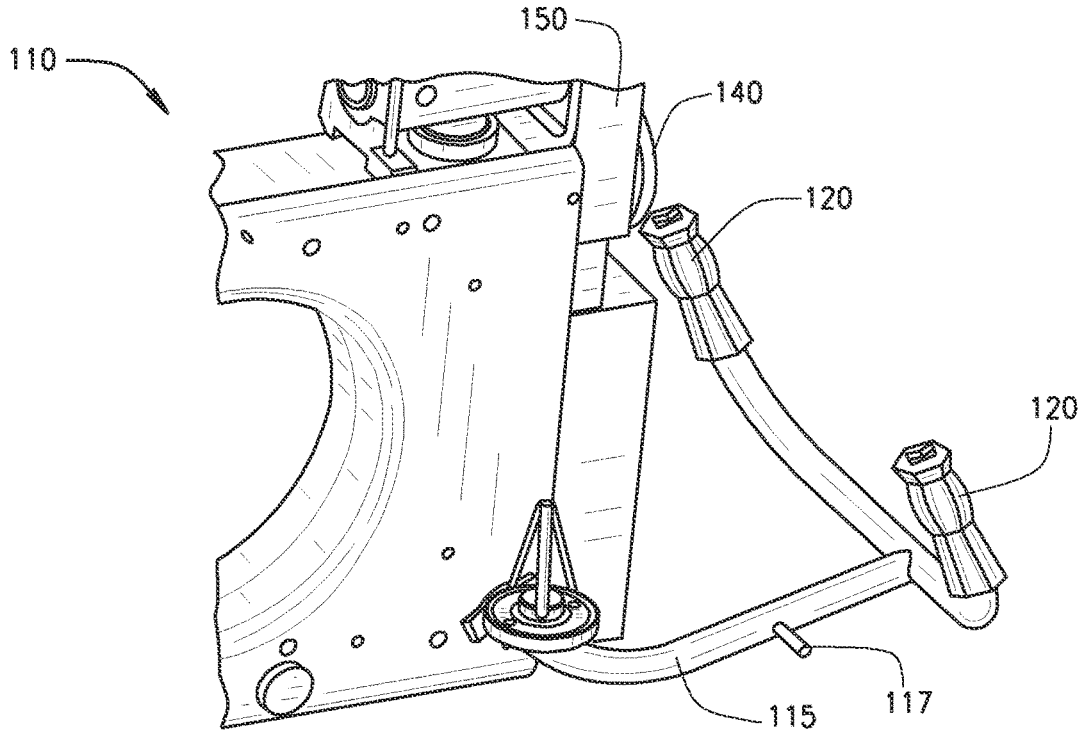
FIG. 3 is a perspective view of a sewing machine head of a long-armed sewing machine with left-sided ergonomic handles attached to the head.
Figure 4:
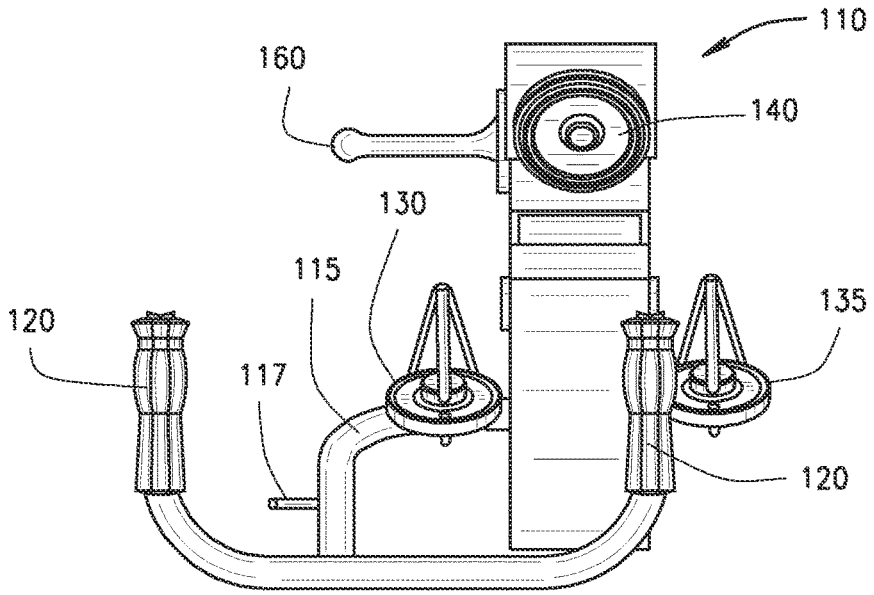
FIG. 4 is a rear elevation view of the sewing machine head and associated left-sided ergonomic handles illustrated in FIG. 3.
Figure 5:
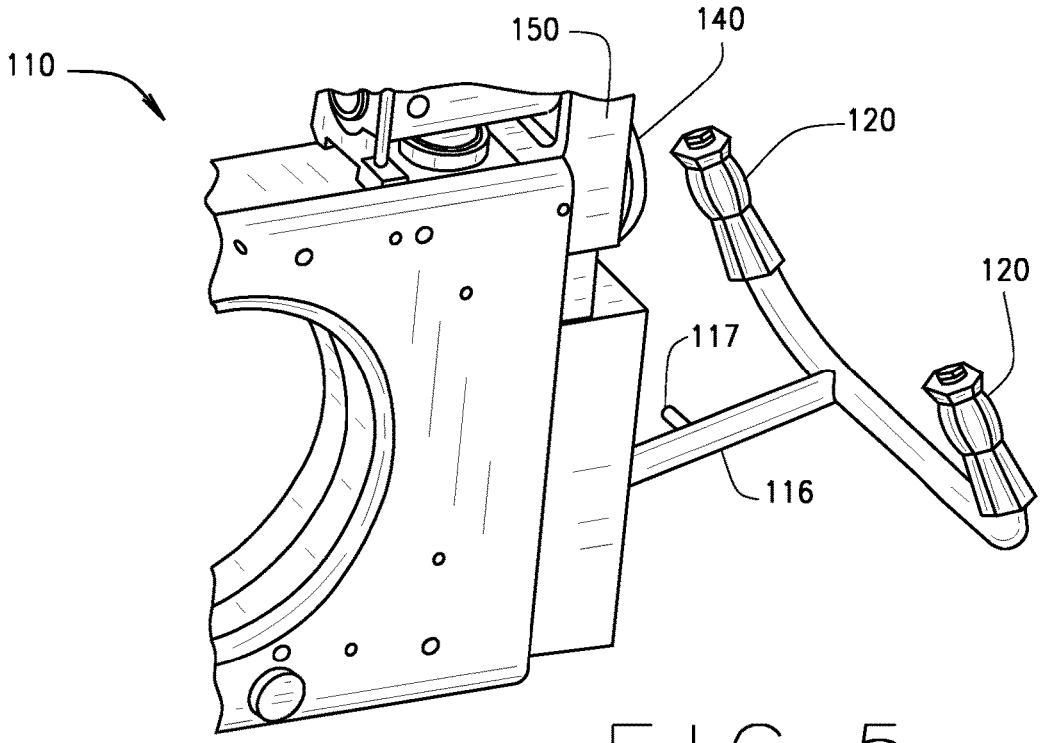
FIG. 5 is a perspective view of a sewing machine head of a long-armed sewing machine with right-sided ergonomic handles attached to the head.
Figure 6:
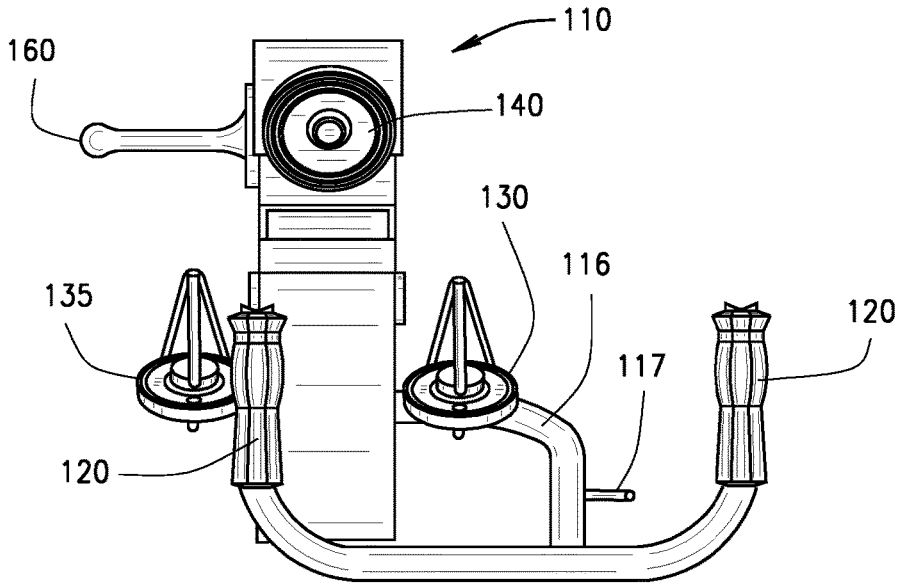
FIG. 6 is a rear elevation view of the sewing machine head and associated right-sided ergonomic handles illustrated in FIG. 5.

The present invention is directed generally toward a sewing machine and handles associated therewith for operating the sewing machine. FIGS. 3, 4, 5, and 6 illustrate a head 110 that improves upon prior art head 10. FIGS. 3 and 5 are perspective views of the rear portion of head 110, and FIGS. 4 and 6 are rear elevation views of the same. As illustrated in FIGS. 3 and 4, head 110 may include an attachment member, preferably L-shaped arm member 115, that extends from the left side portion of head 110 (when viewed from the rear of head 110) and extends rearwardly toward an operator therefrom. Arm member 115 (or 116 in FIGS. 5 and 6) may also include a projection member 117 extending therefrom for mounting a laser to projection 117 in a direction away from head 110. The laser mounted to projection member 117 would be operated in a substantially similar way to that described above for the prior art head 10. Principally it may be used to trace a pantograph, pattern, thus ensuring that the thread and needle associated with head 110 produces a substantially similar pattern. In alternative embodiments, projection member 117 may be positioned and located elsewhere on arm member 115 or 116 or head 110, so long as the laser associated therewith may project a dot or other projection onto a pantograph pattern below the quilt.

In other alternative embodiments the laser associated with head 110 is not mounted to projection member 117. It may be mounted directly to arm member 115 or 116 or elsewhere on head 110. The laser may be positioned and located in a plurality of foreseeable locations, so long as it does not interfere with the operation of head 110 in the quilting process, and the projection generated by the laser used to trace the pantograph pattern is not obstructed.

Figure 1:
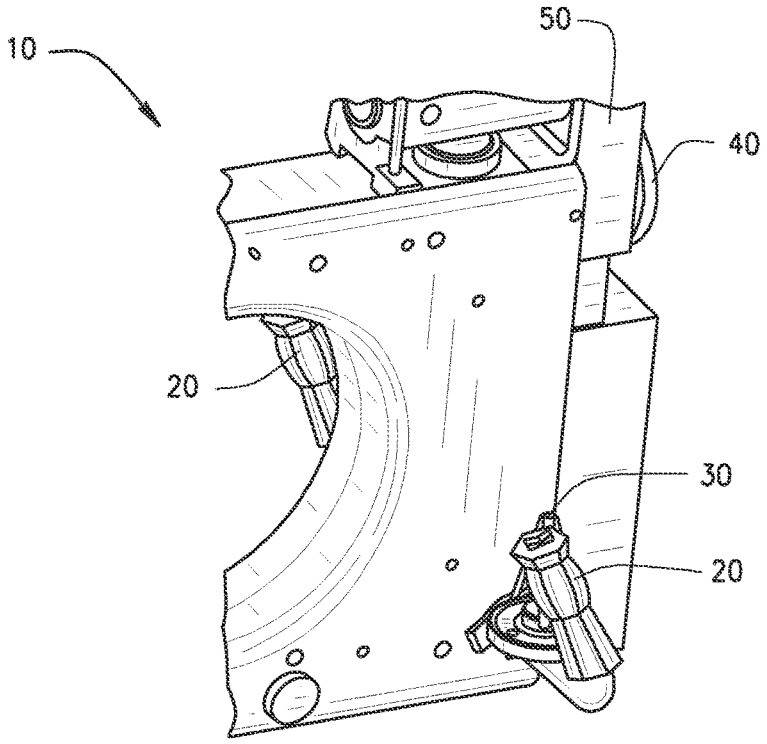
FIG. 1 PRIOR ART
FIG. 1 is a perspective view of a rear portion of a sewing machine head of a long-armed sewing machine with handles mounted on opposing sides of the head.
Figure 2:
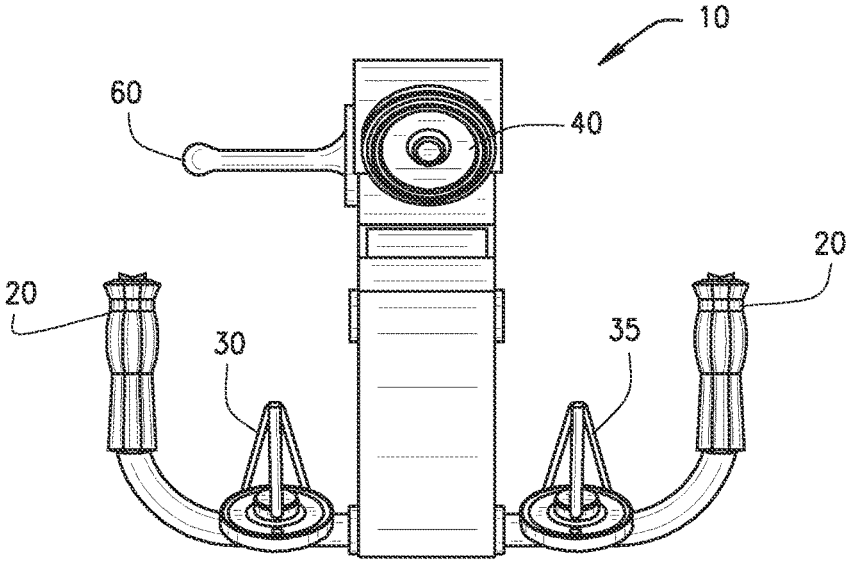
FIG. 2 PRIOR ART
FIG. 2 is a rear elevation view of the sewing machine head and associated handles illustrated in FIG. 1.

Arm member 115 or 116 further may include handles 120 substantially similar to handles 20 illustrated in FIGS. 1 and 2. As a result of handles 120 being attached to the arm member 115 or arm member 116, the handles 120 are offset from the head 110. As an alternative to arm member 115 or 116, other known or foreseeable attachment members may be used to selectively engage head 110 and handles 120.

In the illustrated embodiment, handles 120 are positioned adjacent the left side of the head 110 (when viewed from the rear). In FIGS. 5 and 6, a configuration opposite of that illustrated in FIGS. 3 and 4 is provided. In that embodiment, arm member 116 extends from the right side portion of the head 110, and handles 120 are also positioned adjacent the right side of the head 110 (when viewed from the rear). Such a configuration allows head 110 to be used in a location ergonomically preferable to an operator, which may depend on factors such as pre-existing conditions or right- or left-handedness. Head 110 may include many of the same components as head 10. For example, cone holders 130 and 135 may be semi-permanently or permanently attached on either side of head 110. As illustrated in FIG. 4, one cone holder 130 may be attached to arm member 115 adjacent one side portion of head 110, while another cone holder 135 may be attached to the opposite side portion of head 110 in substantial alignment with cone holder 130. Other familiar components including back hand wheel 140 and belt guard 150 may be associated with head 100. Hand wheel 140 and belt guard 150 may perform substantially the same functions as those described above associated with head 10.

Head 110 further may include thread guide 160. In the illustrated embodiments, thread guide 160 may be positioned and located above cone holder 130 on the left side of rear portion of head 110. In the alternative embodiment described above, where the handles 120 are positioned adjacent the right side of the head 110, thread guide 160 may also extend from the right side of head 110, in a manner substantially similar to that shown in FIGS. 3 and 4, and described herein above.

Head 110 may operate in substantially the same manner as head 10. By using handles 120 to guide head 110, an operator may trace a laser dot associated with head 110 in one of the manners described herein above to ensure that needle and thread performing the quilting process at the front portion of head 110 is reproducing a pantograph pattern or other reproducible pattern. In the embodiment utilizing head 110, however, the operator may operate head 110 via handles 120 and confirm that the laser dot is tracing the pantograph pattern, and the needle and thread is functioning accurately without having to lean to one side or the other.

It should be noted that as an alternative to using a laser to trace a pantograph pattern, a physical pointer may be used instead. For example, a metal or plastic rod may be attached to and project from the handle such that it is positioned and located to physically trace a pantograph pattern to ensure that the needle and thread at the front portion of head 110 are reproducing the pattern. Other known or foreseeable physical means for tracing a pantograph pattern are further envisioned as being able to be used with the present invention. Moreover, digital means of reproducing a pantograph pattern are further envisioned, such as projecting the pattern or reproducing the pattern on a computer or tablet device.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

The invention claimed is:

1. A stitcher head for operating quilting machines, said stitcher head comprising:

one or more handles for controlling movement of said stitcher head;

an attachment member extending horn a side portion of said stitcher head and further attached to said one or more handles such that said one or more handles are offset relative to the stitcher head; and a projection member extending from the attachment member for mounting a laser thereto.

2. The stitcher head of claim 1, wherein the attachment member is an arm member that extends from the left side of the stitcher head.

3. The stitcher head of claim 1, wherein the attachment member is an arm member that extends from the right side of the stitcher head.

4. The stitcher head of claim 1, wherein the stitcher head includes a mechanical pointer attached thereto.

5. The stitcher head of claim 1, wherein the stitcher head includes two handles.

6. A stitcher head for operating quilting machines, said stitcher head comprising:

a handle assembly for operating said stitcher head, wherein said handle assembly is offset from said stitcher head; and wherein said handle assembly is selectively engageable with a left side of said stitcher head and said handle assembly is selectively engageable with a right side of said stitcher head.

7. The stitcher head of claim 6, wherein the handle assembly is selectively engageable with the left side of the stitcher head via an attachment member.

8. The stitcher head of claim 6, wherein the handle assembly is selectively engageable with the right side of the stitcher head via an attachment member.

9. The stitcher head of claim 6, wherein the stitcher head includes a projection member extending from the handle assembly for mounting a laser thereto.

10. The stitcher head of claim 6, wherein the stitcher head includes a mechanical pointer attached thereto.

11. The stitcher head of claim 6, wherein the handle assembly includes two handles.

* * * * *